US010906314B2

(12) United States Patent
Yamagishi et al.

(10) Patent No.: US 10,906,314 B2
(45) Date of Patent: Feb. 2, 2021

(54) LIQUID EJECTING APPARATUS, AND METHOD OF CONTROLLING LIQUID EJECTING APPARATUS

(71) Applicant: SEIKO EPSON CORPORATION, Tokyo (JP)

(72) Inventors: Ken Yamagishi, Shiojiri (JP); Shigeki Suzuki, Shiojiri (JP); Shuji Funada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/584,583

(22) Filed: Sep. 26, 2019

(65) Prior Publication Data

US 2020/0101740 A1 Apr. 2, 2020

(30) Foreign Application Priority Data

Sep. 28, 2018 (JP) ..... 2018-183520

(51) Int. Cl.

| | |
|---|---|
| ***B41J 2/175*** | (2006.01) |
| ***B41J 2/155*** | (2006.01) |
| ***B41J 2/045*** | (2006.01) |
| ***B41J 2/14*** | (2006.01) |

(52) U.S. Cl.

CPC ..... *B41J 2/155* (2013.01); *B41J 2/04541* (2013.01); *B41J 2/04581* (2013.01); *B41J 2/14233* (2013.01); *B41J 2/175* (2013.01); *B41J 2002/14241* (2013.01); *B41J 2002/14419* (2013.01)

(58) Field of Classification Search

CPC .... B41J 2/155; B41J 2/04581; B41J 2/14233; B41J 2/04541; B41J 2002/14419; B41J 2002/14241; B41J 2202/12; B41J 2202/11; B41J 2/18; B41J 2/17509

See application file for complete search history.

(56) References Cited

U.S. PATENT DOCUMENTS 6,152,559 A * 11/2000 Kojima ..... B41J 2/175 347/89

FOREIGN PATENT DOCUMENTS

JP 2005-199596 7/2005

OTHER PUBLICATIONS

Machine translation of JP 2005-199596, published on Jul. 2005 (Year: 2005).*

* cited by examiner

*Primary Examiner* — Huan H Tran
(74) *Attorney, Agent, or Firm* — Workman Nydegger

(57) ABSTRACT

A liquid ejecting apparatus includes: a liquid ejecting head including a plurality of nozzles for discharging liquid and a supply passage through which the liquid to be supplied to the plurality of nozzles flows. The nozzles are arranged in a line; one of the nozzles at a first end of the line being a first end nozzle, whereas one of the nozzles at a second end of the line being a second end nozzle. A height of the first end nozzle is set to be greater than a height of the second end nozzle. The liquid flows through the supply passage in a direction from the first end nozzle to the second end nozzle.

12 Claims, 9 Drawing Sheets

| Ph−Pf | −300 | −500 | −700 | −1000 |
|---|---|---|---|---|
| IMAGE QUALITY | GOOD | FAIR | FAIR | POOR |

LIQUID EJECTING APPARATUS, AND METHOD OF CONTROLLING LIQUID EJECTING APPARATUS

The present application is based on, and claims priority from JP Application Serial Number 2018-183520, filed Sep. 28, 2018, the disclosure of which is hereby incorporated by reference in its entirety.

BACKGROUND

1. Technical Field

The present disclosure relates to a liquid ejecting apparatus with a liquid ejecting head such as an ink jet recording head, and a method of controlling the liquid ejecting apparatus. More specifically, the present disclosure relates to a liquid ejecting apparatus with a liquid ejecting head disposed with a plurality of nozzles positioned at different heights, and a method of controlling the liquid ejecting apparatus.

2. Related Art

Liquid ejecting apparatuses discharge liquid in droplet form from their liquid ejecting heads. Such liquid ejecting apparatuses are used in applications such as ink jet printers, ink jet plotters, and other image recording apparatuses. Because of the property of discharging small amounts of liquid precisely, some contemporary liquid ejecting apparatuses are applied to various manufacturing apparatuses, including: display manufacturing apparatuses that fabricate color filters for liquid crystal displays; electrode forming apparatuses that fabricate electrodes for organic electro luminescence (EL) displays and field emission displays (FEDs) such as surface emitting displays; and chip manufacturing apparatuses that fabricate biochemical elements such as biochips. Specifically, in an image recording apparatus, the recording head discharges liquid containing a color material. In a display manufacturing apparatus, the color material ejecting head discharges liquid containing color materials such as red, green, and blue material. In an electrode forming apparatus, the electrode material ejecting head discharges liquid containing an electrode material. In a chip manufacturing apparatus, the bioorganic substance ejecting head discharges liquid containing a bioorganic substance.

A liquid ejecting head, as described above, has a nozzle forming surface on which a plurality of nozzles through which liquid is to be discharged are formed. These nozzles communicate with respective pressure chambers (pressure generating chambers or cavities) into which liquid flows via supply passages (reservoirs, common liquid chambers, or manifolds) formed in a substrate (passage substrate). In addition, a piezoelectric element (drive element) is provided in each pressure chamber to pressurize and vibrate the liquid.

JP-A-2005-199596 discloses a liquid ejecting apparatus with an ejecting head. In order to precisely discharge liquid droplets onto a three-dimensional (3D) object or slim down its body, this liquid ejecting apparatus can be disposed with the nozzle forming surface of the liquid ejecting head sloped with respect to the horizontal surface and the vertical (gravity) axis (see FIGS. 3 and 4).

The disclosed liquid ejecting apparatus has a disadvantage described below. When the nozzle forming surface is sloped, a plurality of nozzles constituting a nozzle array (group), especially nozzles at both ends of the nozzle array are positioned at different heights. Because of this height difference, the surfaces of liquid in the nozzles of the liquid ejecting head differs from one another. As a result, the back pressure is applied irregularly to the menisci in the nozzles. This may influence the amounts or volumes, flying speeds, and other properties of liquid droplets to be discharged through the nozzles. In general, for liquid ejecting apparatuses having short nozzle arrays, this influence is not significantly exerted on properties, such as the quality of a resultant image. However, recent liquid ejecting apparatuses tend to have longer nozzle arrays in order to accelerate processing by discharging, at one time, larger amounts of liquid droplets through the nozzles. Therefore, the influence may be critical.

SUMMARY

The present disclosure addresses the above situation with an object of providing a liquid ejecting apparatus with a liquid ejecting head that discharges liquid uniformly independently of the difference in height between nozzles, and a method of controlling the liquid ejecting apparatus.

According to a first aspect of the present disclosure, a liquid ejecting head includes: a plurality of nozzles through which liquid is discharged in droplet form; and a supply passage through which the liquid to be supplied to the plurality of nozzles flows. The nozzles are arranged in a line; one of the nozzles at a first end of the line is a first end nozzle, whereas one of the nozzles at a second end of the line is a second end nozzle. A height of the first end nozzle is set to be greater than a height of the second end nozzle. The liquid flows through the supply passage in a direction from the first end nozzle to the second end nozzle.

With the above configuration, the difference in height between the plurality of nozzles, namely, the difference between the pressures generated in the nozzles which is attributed to the difference in height between the surfaces of the liquid in the nozzles is successfully canceled by a pressure loss of the liquid flowing through the supply passage. In this way, properties of the liquid to be discharged through the nozzles can be set uniformly.

The above liquid ejecting head may further include a nozzle forming surface on which the plurality of nozzles are formed. The nozzle forming surface may be inclined to differently set the heights of the first end nozzle and the second end nozzle.

In the above liquid ejecting head, the nozzle forming surface may be inclined to uniformly set a distance between the plurality of nozzles and a print material on which the liquid discharged from the nozzles is to be placed.

The above configuration uniformly sets the distance between the nozzles and the print material, thereby uniformly discharging the liquid onto the print material.

In the above liquid ejecting head, the supply passage may include an inflow portion into which the liquid to be supplied to the plurality of nozzles flows and an outflow portion from which the liquid flows out. The inflow portion may be disposed closer to the first end nozzle than the second end nozzle, whereas the outflow portion may be disposed closer to the second end nozzle than the first end nozzle. The liquid may circulate between the inflow portion and the outflow portion.

The above configuration causes the liquid to circulate between the inflow portion and the outflow portion, thereby extensively setting a rate at which the liquid flows through the supply passage. Consequently, it is possible to extensively adjust the difference in height between the liquid surfaces in the nozzles and the pressure loss in the supply passage.

The above liquid ejecting head may satisfy a relationship specified by an equation:

$$-5000<Ph-Pf\leq 0 \quad (1),$$

where Ph [Pa] denotes a difference between pressures generated in the first end nozzle and the second end nozzle which is attributed to a difference in height between surfaces of the liquid in the first end nozzle and the second end nozzle when the liquid stops flowing through the supply passage, and Pf [Pa] denotes a pressure loss between a point at which the liquid is supplied from the supply passage to the first end nozzle and a point at which the liquid is supplied from the supply passage to the second end nozzle when the liquid is flowing through the supply passage.

This configuration enables menisci to be formed properly in the nozzles, thereby suppressing an occurrence of disadvantages, for example, in which the liquid drips from the nozzles or is not discharged through the nozzles due to improper forming of the menisci.

The above liquid ejecting head may satisfy a relationship specified by an equation:

$$-700<Ph-Pf\leq 0 \quad (2),$$

where Ph [Pa] denotes a difference between pressures generated in the first end nozzle and the second end nozzle which is attributed to a difference in height between surfaces of the liquid in the first end nozzle and the second end nozzle when the liquid stops flowing through the supply passage, and Pf [Pa] denotes a pressure loss between a point at which the liquid is supplied from the supply passage to the first end nozzle and a point at which the liquid is supplied from the supply passage to the second end nozzle when the liquid is flowing through the supply passage.

With the above configuration, a variation in properties of the liquid to be discharged through the nozzles can be reduced.

The above liquid ejecting head may satisfy a relationship specified by an equation:

$$\frac{\rho g}{8\mu}\cdot\sin\theta=\frac{v}{r^2}, \quad (3)$$

where ρ [kg/m$^3$] denotes a density of the liquid, μ [mPa·s] denotes a viscosity of the ink, L [m] denotes a distance between the first end nozzle and the second end nozzle, v [m/s] denotes a rate at which the liquid flows through the supply passage, r [m] denotes a radius of a cross section of the supply passage when the cross section is regarded as a perfect circle, and g [m/s$^2$] denotes a gravitational acceleration.

With the above configuration, a variation in properties of the liquid to be discharged through the nozzles can be further reduced. In other words, properties of the liquid to be discharged through the nozzles can be set further uniformly.

The above liquid ejecting head may further include a plurality of head units, each of which is equipped with the plurality of nozzles. The head units may be arranged side by side along the line in which the nozzles are arranged.

The above configuration with the plurality of head units, each of which is equipped with the plurality of nozzles, can uniformly set properties of the liquid to be discharged through the nozzles even if the nozzles are arrayed considerably long. This liquid ejecting head can be used in various applications.

According to a second aspect of the present disclosure, a liquid ejecting apparatus includes: the liquid ejecting head according to the first aspect; a liquid storage portion that stores liquid to be supplied to the liquid ejecting head; and a liquid feeding mechanism that feeds the liquid stored in the liquid storage portion to the supply passage in the liquid ejecting head.

According to a third aspect of the present disclosure, a method of controlling the liquid ejecting head according to the first aspect includes adjusting a rate at which the liquid flows through the supply passage in accordance with a difference in height between the first end nozzle and the second end nozzle.

In the above control method, the rate at which the liquid flows through the supply passage is adjusted in accordance with the difference in height between the first end nozzle and the second end nozzle. As a result, the difference between the pressures generated in the nozzles which is attributed to the difference in height between the plurality of nozzles, namely, the difference in height between the surfaces of the liquid in the plurality of nozzles is successfully canceled by the pressure loss of the liquid flowing through the supply passage. In this way, properties of the liquid to be discharged through the nozzles can set uniformly.

In the above control method, the liquid may flow through the supply passage at a higher rate as a density of the liquid becomes greater.

With the above control method, properties of the liquid to be discharged through the nozzles can be set uniformly, independently of a density or composition of the liquid.

The above control method may further include performing a flow rate adjusting operation to vary the rate at which the liquid flows through the supply passage when the liquid is not discharged through the nozzles.

With the above control method, the liquid is stirred in the supply passage and the nozzles. Thus, a component contained in the liquid is less likely to settle in the supply passage and the nozzles.

According to a fourth aspect of the present disclosure, a method of controlling a liquid ejecting apparatus comprising employing the method, according to the third aspect, of controlling the liquid ejecting head.

DESCRIPTION OF EXEMPLARY EMBODIMENTS

With reference to the accompanying drawings, some embodiments of the present disclosure will be described below. It should be noted that such embodiments are preferred examples and not intended to narrow the scope of the present disclosure unless otherwise specified. More specifically, a description will be given below of a printer 1 with a plurality of recording heads 2 and a method of controlling the printer 1. The printer 1 with the recording heads 2 is an example of an ink jet recording apparatus with an ink jet recording head. Herein, the ink jet recording apparatus corresponds to a liquid ejecting apparatus, and the ink jet recording head corresponds to a liquid ejecting head.

First Embodiment

Figure 1:
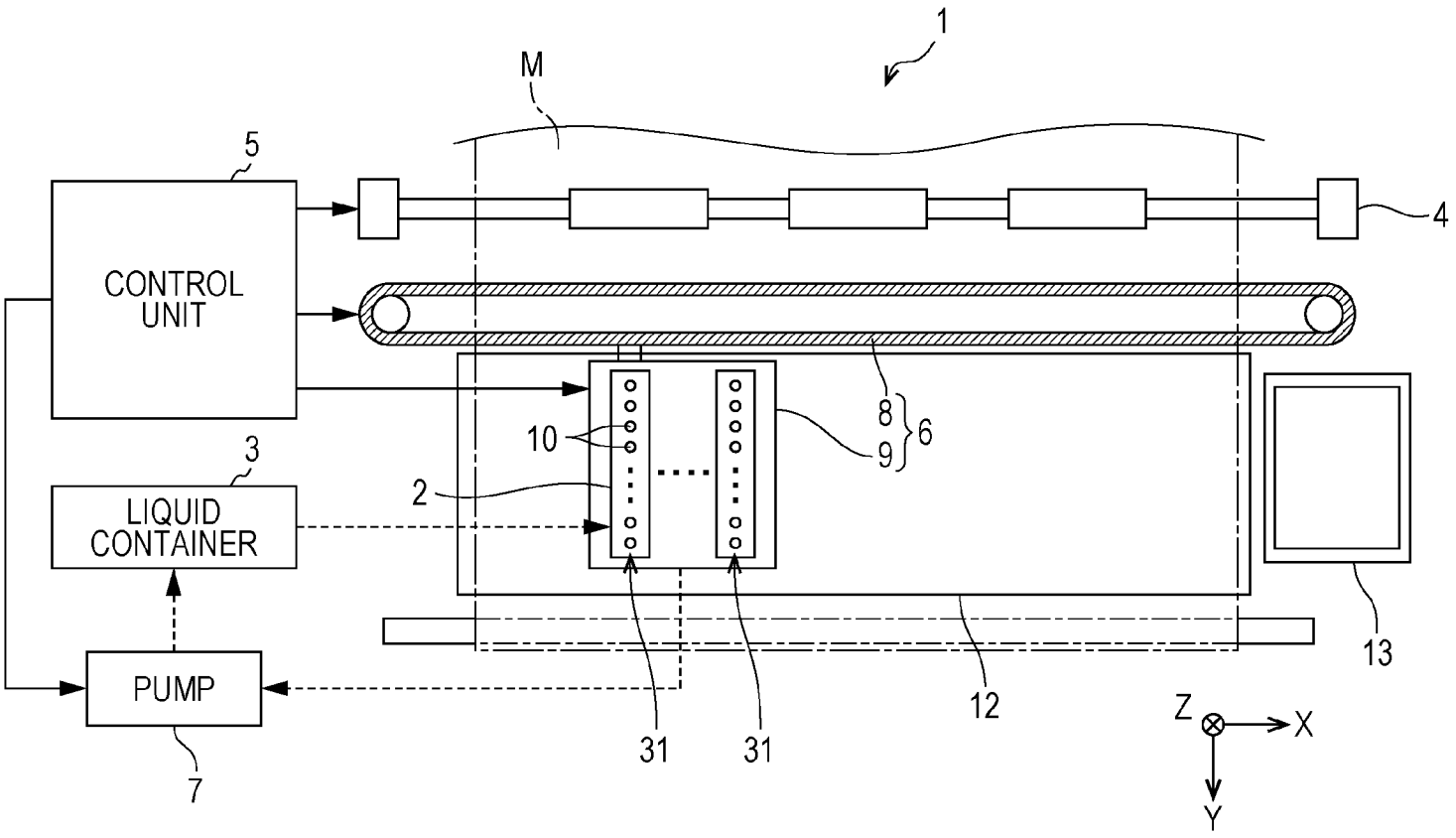
FIG. 1 schematically illustrates a configuration of a liquid ejecting apparatus according to a first embodiment of the present disclosure.
Figure 2:
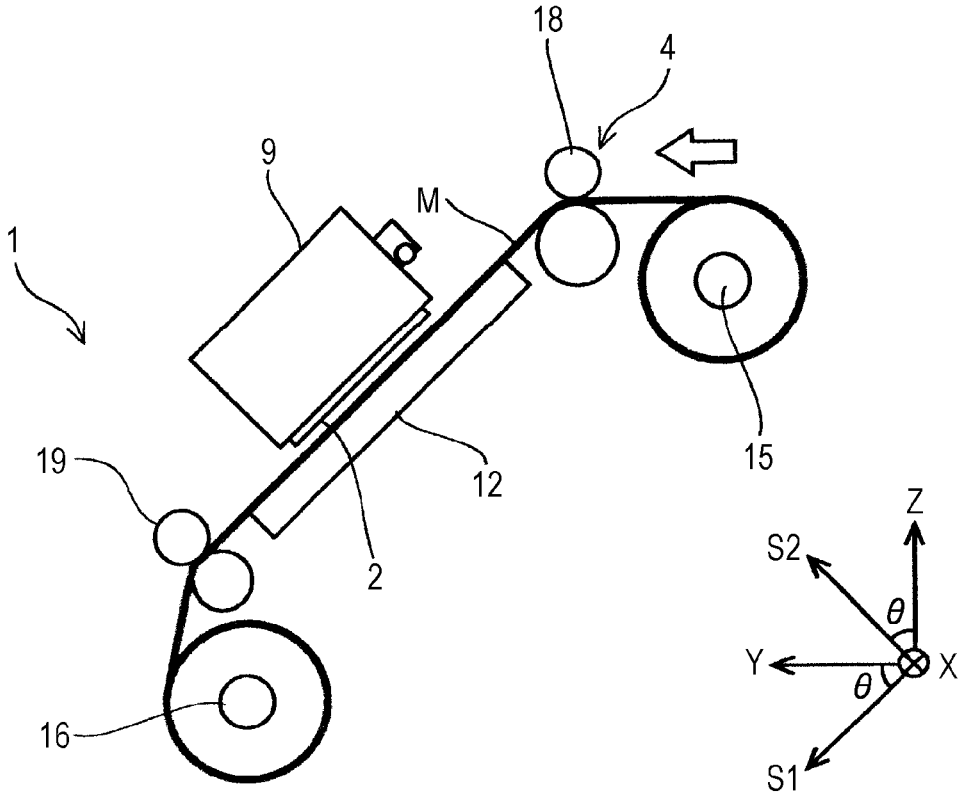
FIG. 2 schematically illustrates the configuration of the liquid ejecting apparatus as seen from one side.

FIG. 1 schematically illustrates a configuration of the printer 1 according to a first embodiment of the present disclosure. FIG. 2 schematically illustrates the configuration of the printer 1 as seen from one side. The printer 1, which may be an ink jet print apparatus, prints an image, a picture, or a letter, for example, on a print medium M. More specifically, the printer 1 includes a plurality of recording heads 2 each of which has arrays of nozzles 10. The printer 1 discharges liquid droplets such as ink droplets toward the print medium M through nozzles 10. Then, these liquid droplets land on the print medium M to form arrays of dots. Herein, the print medium M corresponds to a print material, examples of which include a paper sheet, a resin film, a fabric, and other materials. In the drawings are X, Y, and Z axes that are orthogonal to one another. The XY plane corresponds to the horizontal plane; the Y-axis corresponds to the vertical axis along which the force of gravity is exerted. Each recording head 2 is movable along the X-axis, namely, in main scanning directions; the printer 1 is enlarged along the Y-axis. Each recording head 2 has a nozzle forming surface on which a plurality of nozzles 10 are formed. The whole of each recording head 2 is rotatable around a virtual axis extending along the X-axis so that the nozzle forming surface can be inclined with respect to the XY and YZ planes as well as the Z-axis, or the vertical axis. The angle θ at which the nozzle forming surface is inclined with respect to the Y-axis may be set in the range from 0 to 90 deg., for example. In this case, the axis parallel to the nozzle forming surface, namely, the axis along the thickness of the recording heads 2 is denoted by S1, and the axis orthogonal to the nozzle forming surface is denoted by S2. In this way, the printer 1 is disclosed with the recording heads 2 inclined. In conjunction with the recording heads 2, a platen 12, details of which will be described later, and other components are also inclined. This configuration contributes to a slim or space-saving body of the printer 1.

In addition to the platen 12 and the recording heads 2, the printer 1 further includes a liquid container 3, a pump 7, a transport mechanism 4, a control unit 5, a head moving mechanism 6, and a cap 13. The transport mechanism 4 feeds the print medium M. The liquid container 3, which corresponds to a liquid storage portion herein, stores a plurality of types of inks, such as a plurality of colored inks, to be discharged from the recording heads 2. The liquid container 3 may be, for example, a bag-shaped ink pack made of a flexible film or an ink tank in which the inks are chargeable. The pump 7, which may be a tube pump, for example, forces the inks to flow between the liquid container 3 and the recording heads 2, in other words, to circulate therebetween. Herein, the pump 7 corresponds to a liquid feeding mechanism. The control unit 5 collectively controls the operations of the transport mechanism 4, the head moving mechanism 6, the recording heads 2, the pump 7, and other components. The control unit 5 may include: a processing circuit such as a central processing unit (CPU) or a field programmable gate array (FPGA); and a memory circuit such as a semiconductor memory. The transport mechanism 4 feeds the print medium M to the platen 12 under the control of the control unit 5. The head moving mechanism 6 includes a transport belt 8 and a carriage 9. The transport belt 8 extends along the X-axis and over the print area on the print medium M; the carriage 9 accommodates the recording heads 2 and is fixed to the transport belt 8. The head moving mechanism 6 causes the recording heads 2 mounted in the carriage 9 to reciprocate on an unillustrated guide rail extending along the X-axis, namely, in the main scanning directions, under the control of the control unit 5.

The recording heads 2 are provided in relation to respective inks stored in the liquid container 3 and discharge the inks supplied from the liquid container 3 onto the print medium M through the nozzles 10 under the control of the control unit 5. Each ink may have any given composition; examples of each ink include water-based inks and solvent-based inks. Each recording head 2 has nozzle arrays 31, also called a nozzle group, arranged along the axis S1, namely, in sub-scanning directions. Details of the recording heads 2 will be described later.

The print medium M, which may be a continuous recording paper sheet, a fabric, or a resin film, is stored in a roll shape, more specifically wound around a supply reel 15 as illustrated in FIG. 2. The transport mechanism 4 moves the print medium M over the platen 12, namely, a stage for the print medium M, spaced from the nozzle forming surface of the liquid container 3 on which the nozzles 10 are formed. Then, the recording head 2 prints an image, a figure, or a letter on the print medium M placed on the platen 12, after which the take-up reel 16 winds the print medium M. As illustrated in FIG. 2, the surface of the platen 12 on which the print medium M is to be placed is inclined with respect to the XY plane so as to become substantially parallel to the S1 axis. In this case, the angle at which the surface of the platen 12 is inclined is identical to the inclined angle of the nozzle forming surface of the recording head 2. In short, during the print operation, the angle θ at which both the nozzle forming surface and the surface of the platen 12 are inclined is set in such a way that the distance between the nozzles 10 on the nozzle forming surface and the print medium M become uniform. Setting the angle θ in this manner enables the inks discharged through the nozzles 10 to land on the print medium M accurately. Consequently, the printer 1 successfully prints a quality image, picture, or letter on the print medium M. It should be noted that the print medium M is not limited to a continuous print paper sheet and may be any given print material on which liquid droplets discharged from the recording heads 2 through the nozzles 10 can land. As an alternative example, the print medium M may be a 3D object.

The transport mechanism 4 includes a feed roller pair 18 and a transport roller pair 19. The feed roller pair 18 has a pair of rollers arranged vertically. These rollers rotate in opposite directions with the print medium M therebetween. The feed roller pair 18 rotates by means of power transmitted from an unillustrated drive motor to supply the print medium M from the supply reel 15 to the platen 12. The transport roller pair 19 is disposed opposite the feed roller pair 18 with the platen 12 therebetween. The transport roller pair 19 guides the print medium M on which an image, a picture, or a letter has been printed to the take-up reel 16. It should be noted that the print medium M does not necessarily have to be wound around the take-up reel 16.

Inside the printer 1 is a home position at which the recording heads 2 are on standby. This home position is reserved at one end (right end in FIG. 1) of the platen 12 along the X-axis, or in the main scanning directions. Provided at the home position is the cap 13, which is a tray-shaped member having an aperture facing the nozzle forming surface. The cap 13 can transit between a capping state and a standby state. In the capping state, the cap 13 is in contact with the nozzle forming surface of the recording head 2 to cover the region of the recording heads 2 in each of which the nozzles 10 are arrayed, whereas in the standby state, the cap 13 is at a distance from the nozzle forming surface. The cap 13 formed in this manner covers the nozzle forming surfaces of the recording heads 2 in the standby state at the home position, thereby suppressing the inks from evaporating through the nozzles 10. Furthermore, when the cap 13 enters the capping state and covers the nozzle forming surfaces, a pump or other sucking mechanism may perform a cleaning operation to generate negative pressure inside the cap 13, thereby forcedly absorbing contaminants from the inks through the nozzles 10.

Figure 3:
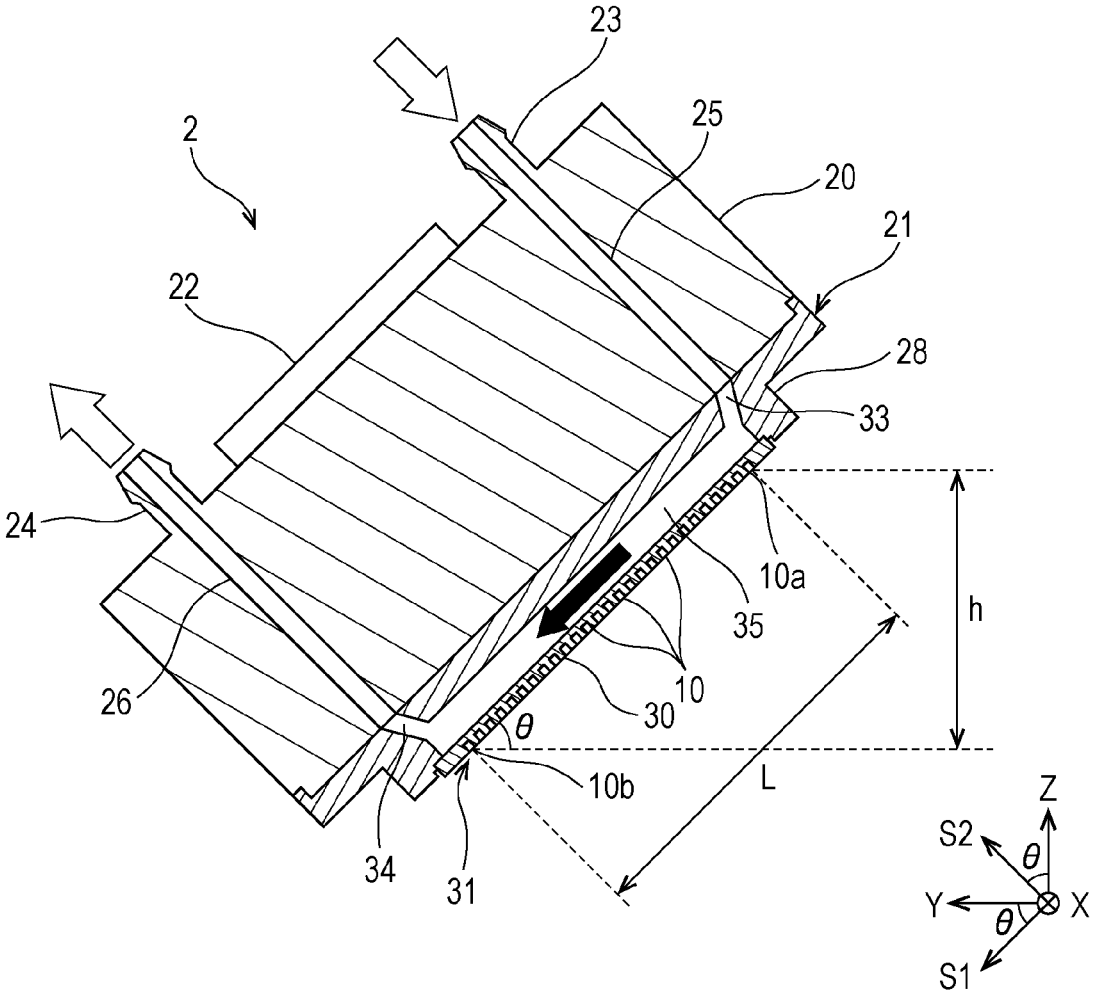
FIG. 3 schematically illustrates a configuration of a cross section of each liquid ejecting head.

FIG. 3 schematically illustrates a configuration of a cross section of each recording head 2 taken along the nozzle arrays. Further, FIG. 3 schematically illustrates a configuration of a cross section of a supply passage 35 in each recording head 2. Each recording head 2 includes a holder 20 and a head unit 21. The holder 20 accommodates an unillustrated circuit substrate that receives drive signals from the control unit 5 and forwards these drive signals to unillustrated pressure generation mechanisms provided in relation to the nozzles 10. The upper surface of the holder 20, namely, one of the surfaces of the holder 20 along the axis S2 which is farther from the head unit 21 is provided, at its substantially center, with a wire insertion part 22. Through the wire insertion part 22, a wire by which the control unit 5 is electrically connected to the above circuit substrate is inserted into each recording head 2. On the upper surface of the holder 20 is an inflow port 23 and an outflow port 24 provided apart from the wire insertion part 22 along the axis S1. Through the inflow port 23, ink is introduced from the liquid container 3 into each recording head 2; through the outflow port 24, the ink that has flowed through the head unit 21 is discharged from each recording head 2 to the liquid container 3. Inside the holder 20 is an inflow passage 25 formed along the height of the holder 20, namely, along the axis S2. Through the inflow port 23 and the inflow passage 25, the ink is supplied to the supply passage 35 in the head unit 21. The inflow passage 25 communicates with an inflow opening 33, which corresponds to an inflow portion herein, in the head unit 21 at a position where the lower surface of the holder 20 is disposed. Inside the holder 20 is an outflow passage 26 formed along the height of the holder 20, namely, along the axis S2. Through the outflow passage 26, the ink that has passed through the supply passage 35 is discharged through the outflow port 24. The outflow passage 26 communicates with an outflow opening 34, which corresponds to an outflow portion herein, in the head unit 21 at a position where the lower surface of the holder 20 is disposed.

The head unit 21 includes a case 28 and a nozzle substrate 30. The nozzle substrate 30 is a planar member with the nozzle arrays 31 each of which includes the plurality of nozzles 10 arrayed at intervals equivalent to the density of dots to be formed. The nozzle substrate 30 may be a silicon substrate or a metal plate made of stainless steel, for example. The surface of the nozzle substrate 30 on which the nozzles 10 are open and which faces the print medium M on the platen 12 corresponds to the nozzle forming surface. As described above, the nozzle forming surface is inclined at the angle θ with respect to both the XY and XZ planes as well as the Z axis, or the vertical axis. In conjunction with the nozzle forming surface, the nozzle arrays 31 formed along the axis S1 are also inclined along the Z-axis. In this case, a first end nozzle 10*a* is positioned higher than a second end nozzle 10*b* in the transport direction of the print medium M; the first end nozzle 10*a* is at the upstream end of the nozzle array 31, whereas the second end nozzle 10*b* is at the downstream end of the nozzle array 31 in the transport direction. This means that there is a difference in height between the nozzles 10 in the nozzle arrays 31. As an example, a length L of each nozzle array 31, which is equivalent to the distance between the centers of the first end nozzle 10*a* and the second end nozzle 10*b*, may be set to 2 in. (approximately 51 mm). It should be noted that any number of nozzle arrays 31 may be formed in the nozzle substrate 30 along the X-axis.

The supply passage 35 into which the ink flows through the inflow passage 25 is formed inside the case 28. The supply passage 35 extends along each nozzle array 31, namely, along the axis S1 and communicates with the nozzles 10 of the nozzle array 31. Further, the supply passage 35 serves as a liquid supply chamber shared by the plurality of nozzles 10 and is continuously formed between the first end nozzle 10*a* and second end nozzle 10*b* of the nozzle array 31 along the axis S1. The upstream end of the supply passage 35 communicates with the inflow passage 25 through the inflow opening 33, whereas the downstream end of the supply passage 35 communicates with the outflow passage 26 through the outflow opening 34.

The head unit 21 in each recording head 2 further includes: individual passages formed between the supply passage 35 and the respective nozzles 10; and a pressure generation mechanisms such as piezoelectric elements or heater elements that force the ink to be discharged through the nozzles 10; the individual passages and the pressure generation mechanisms are provided for the respective nozzles 10. The individual passage may accommodate pressure chambers in which pressure for use in discharging ink droplets through the nozzles 10 is to be generated by the pressure generation mechanisms. Each recording head 2 discharges the ink in droplet form through the nozzles 10 by means of the pressure applied to the ink in the pressure chambers. Herein, the position at which the individual passages are separated from the supply passage 35 toward the nozzles 10 corresponds to a point at which liquid is supplied.

In the printer 1 configured above, when the pump 7 forces each ink in the liquid container 3 to flow into the supply passage 35 through the inflow port 23, the inflow passage 25, and the inflow opening 33, each ink flows, along the axis S1, from the first end nozzle 10*a* to the second end nozzle 10*b* of the nozzle array 31, as indicated by the thick arrow in FIG. 3. Some of each ink which has flowed through the supply passage 35 but has not been discharged via the nozzles 10 is returned from the outflow opening 34 to the liquid container 3 through the outflow passage 26 and the outflow port 24. In short, the inks circulate between each recording head 2 and the liquid container 3. In other words, the inks circulate between the inflow opening 33 and the outflow opening 34 in each recording head 2.

Figures 4, 5:
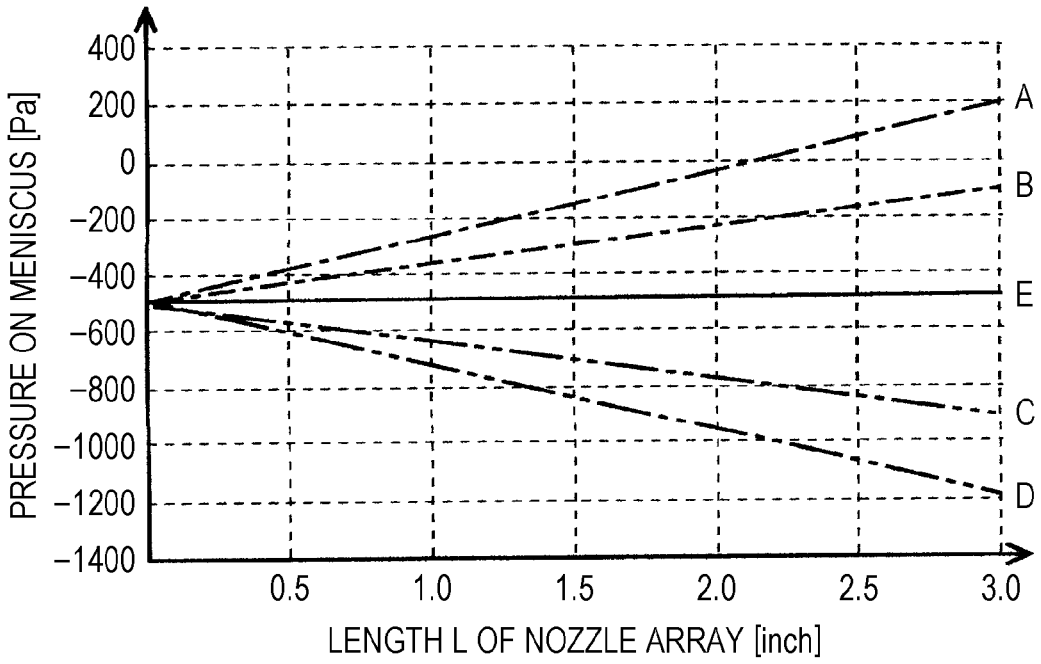
FIG. 4 is a graph showing the relationship between the length of a nozzle array and a pressure applied to the meniscus in each nozzle of the nozzle array.
FIG. 5 is a table showing the result of a survey regarding the dependence of an image quality upon the difference between a pressure difference and a pressure loss, which are attributed to the difference in height between ink surfaces in the nozzles.

FIG. 4 is a graph showing the relationship between a length L of a nozzle array 31 and a pressure applied to the surface, or the menisci, of ink inside each nozzle 10 of a nozzle array 31 in a recording head 2. This pressure is equivalent to the back surface applied to the passages inside the recording head 2. In this graph, each of the lines A and B indicate the dependence of the pressure upon the difference in height between an ink surface in the nozzles 10 when the ink does not flow through the supply passage 35. Further, the line A is obtained by plotting pressures generated in the respective nozzles 10 when the nozzle forming surface of a recording head 2 is inclined at 60 deg., whereas the line B is obtained when the nozzle forming surface is inclined at 30 deg. Both the lines C and D indicate the dependence of the pressure upon a pressure loss in the supply passage 35 when there is no difference in height between the liquid surfaces in nozzles 10 of a nozzle array 31. Further, the line C is obtained by plotting pressures generated in the respective nozzles 10 when the ink flows at a rate of $0.9\times10^{-3}$ m/s, whereas the line D is obtained when the ink flows at a rate of $1.5\times10^{-3}$ m/s. The line E indicates a target or ideal pressure in each nozzle 10. In order to form the menisci in a nozzle 10 so that an ink droplet can be discharged properly, the pressure applied to the meniscus is typically maintained at a negative value E. As described above, the recording head 2 is disposed with the nozzle forming surface inclined at the angle θ with respect to both the XY and XZ planes. The heights of the nozzles 10 of the nozzle array 31 therefore differ from one another. In this case, the heights of the ink surface in the nozzles 10 differ from one another, and the pressures applied to the menisci in the nozzles 10 also differ from one another. Furthermore, FIG. 4 demonstrates that the difference between pressures generated in a first end nozzle 10*a* and second end nozzle 10*b* of the nozzle array 31 increases with increase in the length L of the nozzle array 31, and also increases with increase in the angle θ. If the pressure applied to a meniscus exceeds 0 Pa., the ink may drip from the nozzle 10.

As the length L of the nozzle array 31 increases, the length of the supply passage 35 increases. When the supply passage 35 is lengthened, the pressure loss of the supply passage 35 on the downstream side increases. As a result, the pressures applied to the menisci in the nozzles 10 in the supply passage 35 differ from one another. FIG. 4 demonstrates that the difference between the pressures generated in the first end nozzle 10*a* and the second end nozzle 10*b* increases with increase in the length L of the nozzle array 31 and also increases with increase in the rate at which the ink flows through the supply passage 35. If the pressure applied to the meniscus in a nozzle 10 falls below −5000 Pa, the meniscus may be formed improperly, in which case the ink might fail to be discharged through the nozzle 10.

When the nozzle forming surface of a recording head 2 in the printer 1 is inclined, the heights of nozzles 10 of a nozzle array 31, especially the heights of a first end nozzles 10*a* and a second end nozzle 10*b* differ from one another. Furthermore, the ink flows through the supply passage 35 in the direction from the first end nozzle 10*a* to the second end nozzle 10*b*. In this configuration, the control unit 5 controls the operation of the pump 7 in such a way that an appropriate amount of ink flows through the supply passage 35 in accordance with the difference in height between the first end nozzle 10*a* and the second end nozzle 10*b*. In this way, the difference between pressures generated in the nozzles 10 which is attributed to the difference in height between the ink surfaces in the nozzles 10 is successfully canceled by the pressure loss in the supply passage 35, so that the difference between pressures applied to the menisci in the nozzles 10 fall within an acceptable range. More specifically, if the pressure applied to the meniscus in a first end nozzle 10*a* is set to a target value determined on a design basis, the recording head 2 needs to satisfy the relationship specified by equation A:

$$-5000<Ph-Pf\leq0 \tag{A}$$

where Ph [Pa] denotes the difference between the pressure generated in the first end nozzle 10*a* and the second end nozzle 10*b* which is attributed to the difference in height between the ink surfaces in the first end nozzle 10*a* and the second end nozzle 10*b*, and Pf [Pa] denotes the pressure loss in the supply passage 35 between points at which the ink is supplied to the first end nozzle 10*a* and at which the ink is supplied to the second end nozzle 10*b*.

The above pressure difference Ph is expressed by equation B:

$$\begin{aligned} P_h &= \rho g h \\ &= \rho g L\cdot\sin\theta \end{aligned} \tag{B}$$

where ρ [kg/m$^3$] denotes the density of the ink, L [m] denotes the length of the nozzle array 31, or the distance between the first end nozzle 10*a* and the second end nozzle 10*b*, *h* [m] denotes the difference in height between the first end nozzle 10*a* and the second end nozzle 10*b*, and g [m/s$^2$] denotes the gravitational acceleration.

The above pressure loss Pf is expressed by equation C:

$$P_f = \frac{8\mu L v}{r^2} \tag{C}$$

where μ [mPa·s] denotes the viscosity of the ink, v [m/s] denotes a rate at which the ink flows through the supply passage 35, and r [m] denotes the radius of the cross section of the supply passage 35 when the cross section is regarded as a perfect circle. By satisfying the relationship specified by equation A described above, the menisci can be formed properly in the respective nozzles 10, including the second end nozzle 10*b*, or the lowest nozzle of the nozzle array 31. In which case, the ink is less likely to drip from the nozzles 10 or fail to be discharged in droplet form due to improper forming of the menisci.

Figure 6:
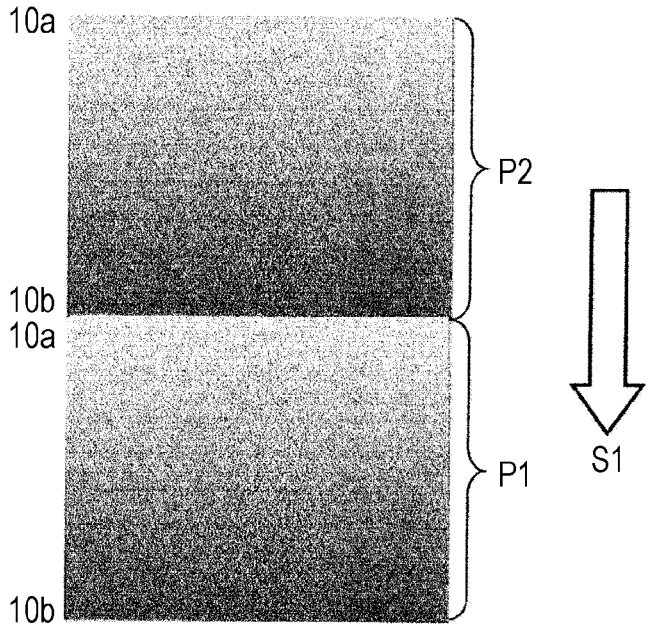
FIG. 6 schematically illustrates solid images with a non-uniform density.
Figure 7:
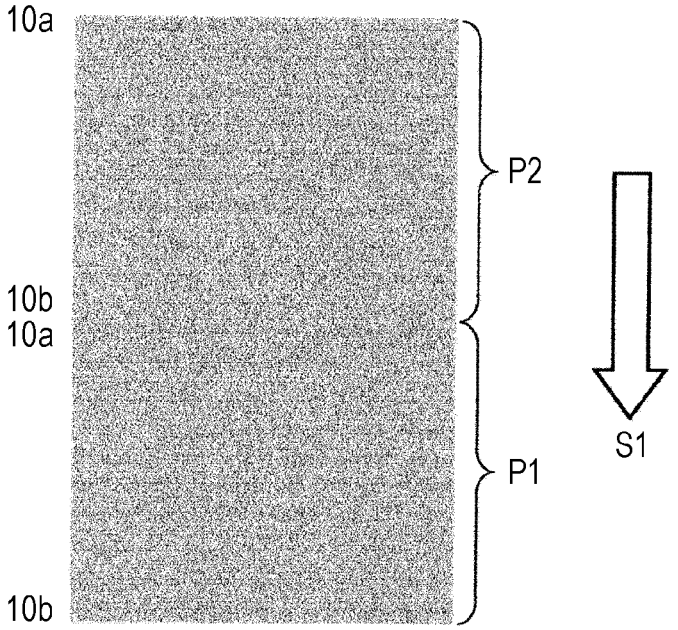
FIG. 7 schematically illustrates solid images with a uniform density.

FIG. 5 is a table showing the result of a survey regarding the dependence of an image quality upon the difference between a pressure difference Ph and a pressure loss Pf, which are both attributed to the difference in height between the ink surfaces in the nozzles. FIGS. 6 and 7 each schematically illustrate solid images on a print medium M which a recording head 2 prints by discharging ink droplets through nozzles 10 of a nozzle array 31 during two scanning units, or two passes. The density of the solid images in FIG. 6 is relatively non-uniform, but the density of the solid images in FIG. 7 is relatively uniform. In FIGS. 6 and 7, an image P1 is the solid image printed during the first pass, whereas an image P2 is the solid image printed during the second pass. First, the recording head 2 prints the image P1 during the first pass and then performs sub-scanning in which the print medium M is fed by an amount according to the length L of the nozzle array 31 along the axis S1 denoted by the arrow. After that, the recording heads 2 prints the image P2 during the second pass. On the left of each of the images P1 and P2 in FIGS. 6 and 7, the mark 10*a* indicates the position of the first end nozzle 10*a* and the mark 10*b* indicates the position of the second end nozzle 10*b*.

The table of FIG. 5 shows the result of a survey regarding the qualities of the images printed with (Ph−Pf) varied. In this survey, 100 persons viewed, with the naked eye, the images P1 and P2 printed with (Ph−Pf) set to −300, −500, −700, and −1000 and answered whether they could visually perceive the border between the images P1 and P2 which becomes clear depending on non-uniformity of an image density. This result shows how many persons could visually perceive the border. The "Good" indicates that no or one person could perceive the border, which means that the image printed with (Ph−Pf) set to −300 exhibits a uniform density. The "Fair" indicates that two to ten persons could perceive the border, which means that the images printed with (Ph−Pf) set to −500 and −700 exhibit a non-uniformity density but nevertheless it falls within an allowable range. The "Poor" indicates that 50 or more persons could perceive the border, which means that the image printed with (Ph−Pf) set to −1000 exhibits a prominently non-uniform density, which falls outside the allowable range.

In consideration of the result of FIG. 5, the recording head 2 preferably satisfy the relationship specified by equation D:

$$-700 < Ph - Pf \leq 0 \tag{D}$$

where Ph [Pa] denotes the difference between the pressures generated in the first end nozzle 10*a* and the second end nozzle 10*b* which is attributed to the difference in height between the ink surfaces in the first end nozzle 10*a* and the second end nozzle 10*b*, and Pf [Pa] denotes the pressure loss in the supply passage 35 between points at which the ink is supplied to the first end nozzle 10*a* and at which the ink is supplied to the second end nozzle 10*b*. By satisfying the relationship specified by equation D, it is possible to reduce a variation in properties of the ink to be discharged through the nozzles 10 which may affect the quality of a resultant image.

To cause the difference between the pressures generated in the nozzles 10 to be effectively canceled by the difference in height between the ink surfaces, or the menisci, in the nozzles 10 and the pressure loss in the supply passage 35, the pressure difference Ph and the pressure loss Pf are preferably set to the same value. In short, the recording head 2 preferably satisfy the relationship specified by equation E:

$$\rho g L \cdot \sin\theta = \frac{8\mu L v}{r^2}. \tag{E}$$

Introduced from equation E is equation F:

$$\frac{\rho g}{8\mu} \cdot \sin\theta = \frac{v}{r^2}. \tag{F}$$

By satisfying equation F, it is possible to further reduce a variation in properties of the ink to be discharged through the nozzles 10, in other words, further uniformly set properties of the ink to be discharged through the nozzles 10. Consequently, the printer 1 can print a quality image, picture, or letter on the print medium M. To satisfy the relationships specified by the above equations, it is necessary to adjust a flow rate of the ink in the supply passage 35 in accordance with the length L of the nozzle array 31 and the angle θ of the nozzle forming surface. Moreover, in addition to the length L of the nozzle array 31 and the angle θ of the nozzle forming surface, a composition of the ink may also influence the height of the ink surface in each nozzle 10. For example, when ink containing metal particles such as titanium dioxide particles is used, the difference in height between the liquid surfaces in the nozzles 10 becomes greater than that when regular water-based ink is used, because the ink containing metal particles has a larger density than that of water-based ink. In this case, the control unit 5 preferably controls the operation of the pump 7 in such a way that the flow rate of the ink in the supply passage 35 increases, thereby successfully uniformly setting properties of the ink to be discharged through the nozzles 10 in accordance with an ink type. Furthermore, for example, when the printer 1 stops a print operation on the print medium M, such as when the printer 1 switches a main scanning direction of the recording head 2 or when the recording head 2 performs the sub-scanning operation on the print medium M, or when the printer 1 is on standby after having performed the print operation, the control unit 5 preferably performs a flow rate adjusting operation to vary the flow rate of the ink in the supply passage 35 regardless of which type of ink is to be used. Performing the flow rate adjusting operation in this manner can stir the ink in the supply passage 35 and the nozzles 10, thereby suppressing a solid and other component, such as a pigment, contained in the ink from settling in the supply passage 35 and the nozzles 10. In this way, the control unit 5 increases the flow rate of the ink in the supply passage 35 to stir the ink during the period in which the printer 1 does not perform the print operation, in other words, during the standby state in which the ink is not discharged through the nozzles 10. Consequently, it is possible to effectively suppress a component, such as a pigment, contained in the ink from settling in the supply passage 35 and the nozzles 10 when the printer 1 is on standby.

In the recording head 2, the ink is supplied to the supply passage 35 in the direction from the first end nozzle 10*a* to the second end nozzle 10*b*. In this case, the outflow opening 34 may be removed from the supply passage 35 so that the ink does not circulate. However, if the pump 7 forces the ink to circulate between the inflow opening 33 and outflow opening 34 in the recording heads 2, or between the recording head 2 and the liquid container 3 as in this embodiment, the control unit 5 can supply the ink to the supply passage 35 at a wider range of flow rate. Consequently, it is possible to extensively adjust the height of the ink surface in each nozzle 10 and the pressure loss in the supply passage 35 in balance, thereby providing a recording head 2 with a longer nozzle array 31, for example, having a length of 2.0 in.

If the length L of the nozzle array 31 in the recording head 2 considerably increases, when the nozzle forming surface is inclined at a certain angle θ while the ink stops flowing or circulating through the supply passage 35, the ink surface of lower nozzles 10 is higher than that of higher nozzles 10. In this case, the ink may drip from the lower nozzles 10. Therefore, when the ink stops circulating in response to the power-off of the printer 1 that has performed the print operation, for example, it is preferable that the nozzle forming surface of the recording head 2 which has been inclined be rotated at the home position until it becomes parallel to the XY plane, or the installation plane of the printer 1, and then covered by the cap 13. This operation can suppress the ink from dripping due to the difference in height between the ink surfaces in the nozzles 10 even when the ink stops flowing through the supply passage 35. Even if the ink drops from the nozzles 10, the ink lands within an area covered by the cap 13, thereby less likely to pollute internal components of the printer 1 and the print medium M.

There are cases where the XY plane does not coincide with the horizontal plane when the printer 1 is installed. Therefore, when determining the flow rate of the ink in the supply passage 35, the control unit 5 preferably compensates for the difference in height between the nozzles 10, namely, between the ink surfaces of the nozzles 10. In this way, the control unit 5 can set and adjust the flow rate more appropriately.

Second Embodiment

Figure 8:
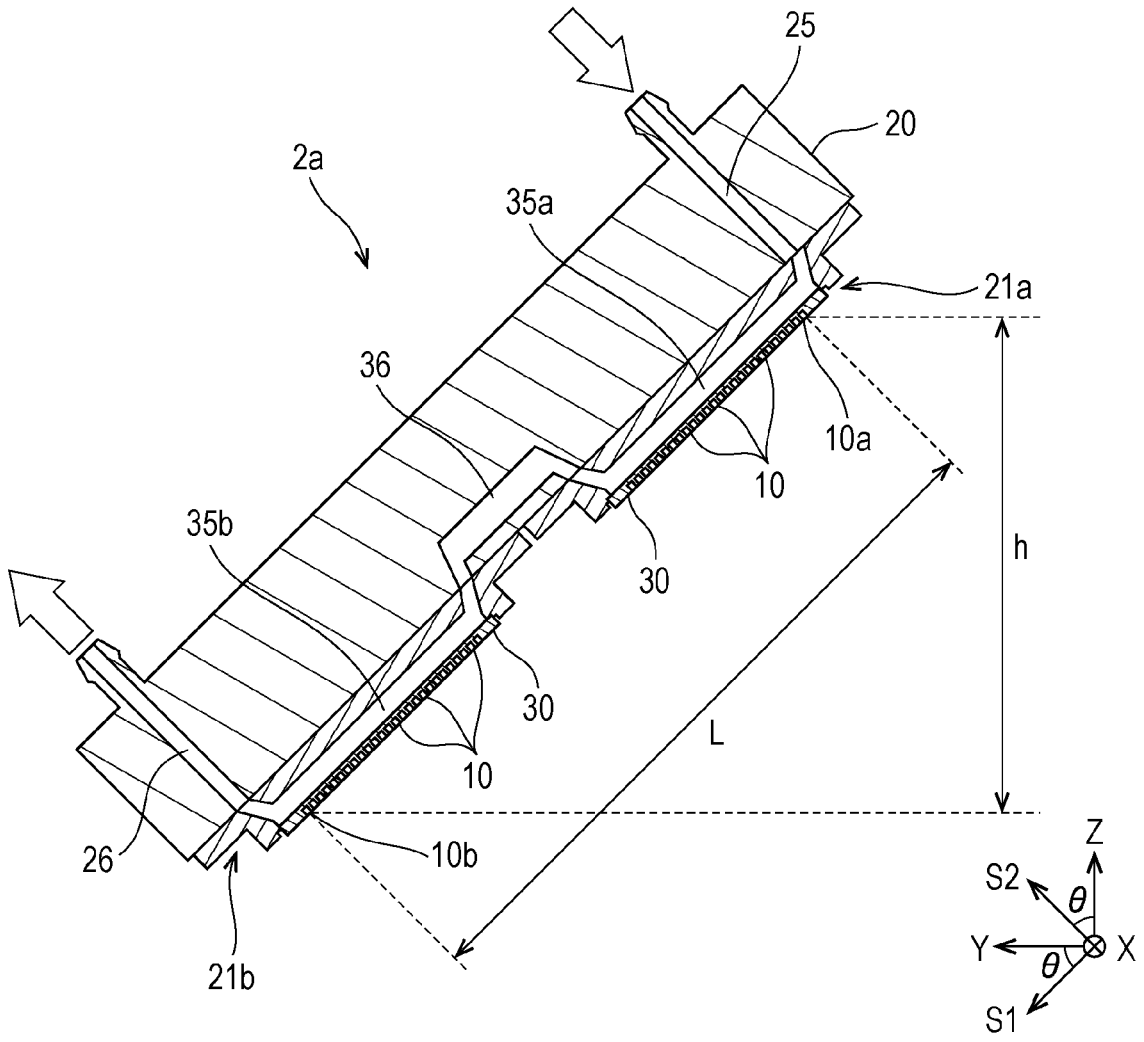
FIG. 8 schematically illustrates a configuration of a cross section of a liquid ejecting head according to a second embodiment of the present disclosure.

FIG. 8 schematically illustrates a configuration of a cross section of a recording head 2*a* according to a second embodiment of the present disclosure. In FIG. 8, components identical to those in the foregoing first embodiment are given the same reference characters and will not be described below. The recording head 2*a* includes a plurality of head units, or a first head unit 21*a* and a second head unit 21*b*, and the total length L of their nozzle arrays accordingly increases. In the example of FIG. 8, the first head unit 21*a* and the second head unit 21*b* are attached to a holder 20 while being arranged side by side along their nozzle arrays, or along an axis S2. The first head unit 21*a* has a first supply passage 35*a*, and the second head unit 21*b* has a second supply passage 35*b*; the first supply passage 35*a* communicates with the second supply passage 35*b* via a communication passage 36 formed in the holder 20. The same ink flows through both the first supply passage 35*a* and the second supply passage 35*b*. In the recording head 2*a*, the first supply passage 35*a*, the communication passage 36, and the second supply passage 35*b* constitute a continuous supply passage. The configuration in this embodiment is similar to that in the foregoing first embodiment in that the recording head 2*a* and its nozzle forming surface are inclined at an angle θ with respect to the XY and XZ planes as well as the Z-axis, or the vertical axis. In addition, the nozzle arrays in the first head unit 21*a* and the second head unit 21*b* extend along the axis S1 parallel to the nozzle forming surface. When the nozzle arrays in the first head unit 21*a* and the second head unit 21*b* through which the same ink flows are regarded as a single nozzle array, the nozzle 10 positioned at the upstream end of this single nozzle array in a transport direction of a print medium M is a first end nozzle 10*a*, whereas the nozzle 10 positioned at the downstream end of the single nozzle array in the transport direction is a second end nozzle 10*b*.

Similar to the foregoing first embodiment, a control unit adjusts a rate at which ink flows through both the first supply passage 35*a* and the second supply passage 35*b* in accordance with the total length L of the supply passages and the angle θ of the nozzle forming surface. In this case, the difference between the pressures generated by the nozzles 10 which is attributed to the difference in height between the liquid surfaces in the nozzles 10 is canceled by a total pressure loss in the first supply passage 35*a* and the second supply passage 35*b*. In this way, properties of the ink to be discharged through the nozzles 10 can be set uniformly. Providing the plurality of head units in this manner can uniformly set properties of the liquid to be discharged through the nozzles 10 even if the nozzles 10 are arrayed considerably long in the recording head 2*a*. The recording head 2*a* configured above can be used in various applications. In the example of FIG. 8, the two head units, or the first head unit 21*a* and the second head unit 21*b*, are attached to the holder 20 while being arranged side by side along the nozzle array, or the axis S2; however, any number of head units may be attached to the holder 20. If three or more head units are arranged side by side along the axis S1, the head units are preferably alternately staggered along the X-axis. In addition, the nozzle arrays of the head units are preferably formed such that, as viewed from the axis S2, the spacing between the nozzle arrays is related to intervals between nozzles 10, more specifically the spacing between the nozzle arrays becomes shorter than each interval of the nozzles. Other configurations are identical to those in the foregoing first embodiment.

Third Embodiment

Figure 9:
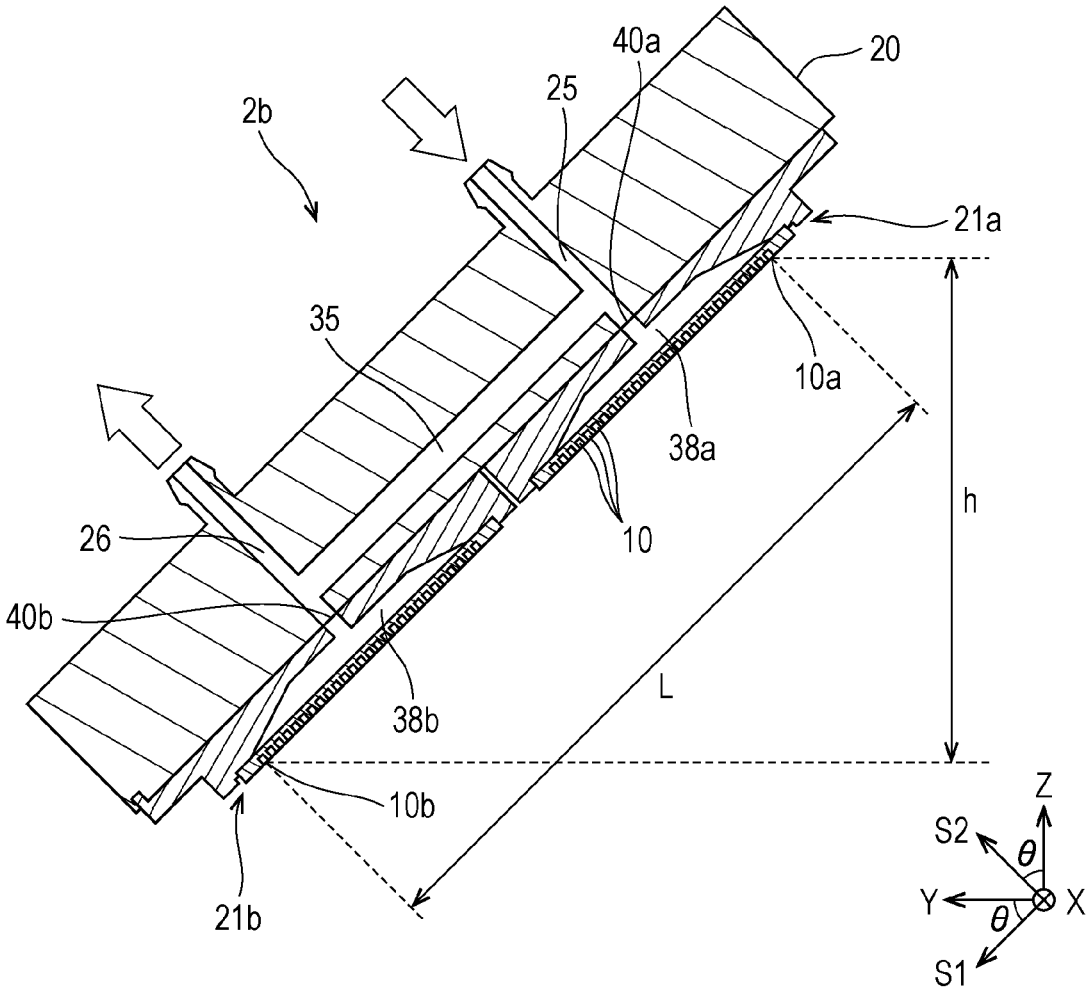
FIG. 9 schematically illustrates a configuration of a cross section of a liquid ejecting head according to a third embodiment of the present disclosure.
Figure 10:
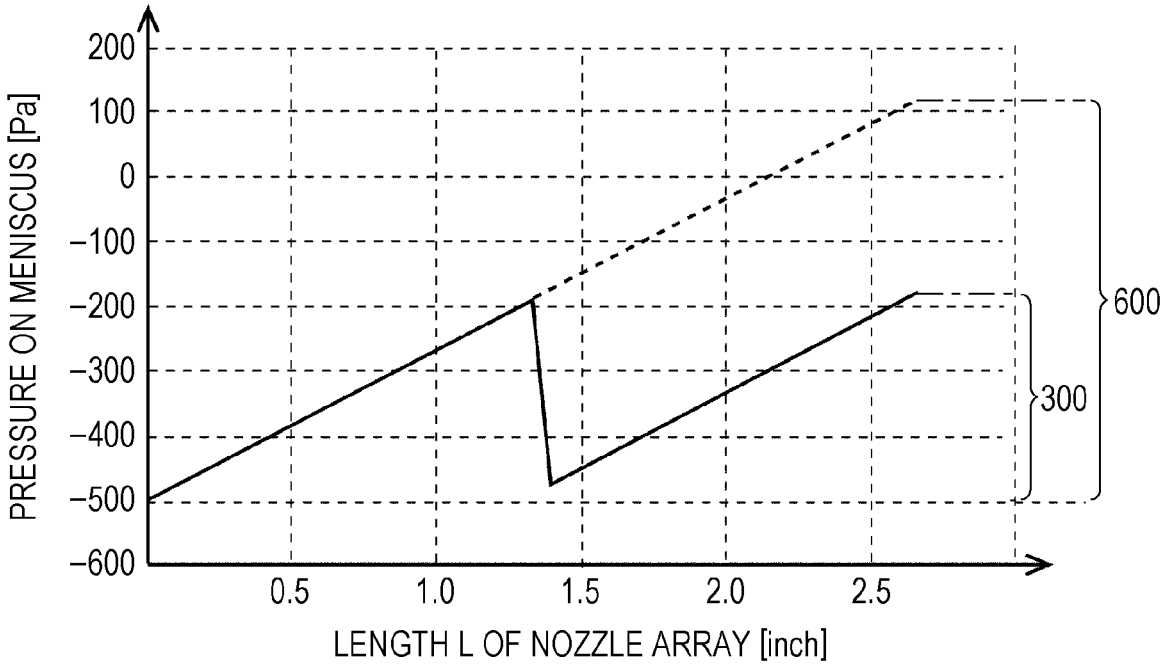
FIG. 10 is a graph showing the relationship between the total length of nozzle arrays and a pressure applied to the meniscus in each nozzle of the nozzle array.

FIG. 9 schematically illustrates a configuration of a cross section of a recording head 2*b* according to a third embodiment of the present disclosure. In FIG. 9, components identical to those in the foregoing first or second embodiment are given the same reference characters and will not be described below. FIG. 10 is a graph showing the relationship between a total length L of the nozzle arrays and a pressure applied to the meniscus in a nozzle 10. The recording head 2*b* is similar to the recording head 2*a* in the foregoing second embodiment in that a plurality of head units, or a first head unit 21*a* and a second head unit 21*b*, are arranged side by side and a total length L of the nozzle arrays accordingly increases. However, the recording head 2*b* has some differences from the recording heads 2*a*. Specifically, a supply passage 35 is provided in neither the first head unit 21*a* nor the second head unit 21*b* but provided in a holder 20. Furthermore, in the first head unit 21*a* is a common liquid chamber 38*a*, whereas in the second head unit 21*b* is a common liquid chamber 38*b*. Each of the common liquid chamber 38*a* and the common liquid chamber 38*b* are shared by some nozzles 10. The supply passage 35 communicates with the common liquid chamber 38*a* via a first supply opening 40*a* and the common liquid chamber 38*b* via a second supply opening 40*b*. The first supply opening 40*a* is a point at which ink is to be supplied to a first end nozzle 10*a* in the supply passage 35 through the first supply opening 40*a*, whereas the second supply opening 40*b* is a point at which the ink is to be supplied to a second end nozzle 10*b* in the supply passage 35 through the second supply opening 40*b*. Similar to the foregoing second embodiment, the recording head 2*b* and its nozzle forming surface are inclined at an angle θ with respect to the XY and XZ planes as well as the Z-axis, or the vertical axis. In addition, the nozzle arrays in the first head unit 21*a* and the second head unit 21*b* extend along the axis S1, which is parallel to the nozzle forming surface.

In the above configuration, the ink flows through both the common liquid chamber 38*a* in the first head unit 21*a* and the common liquid chamber 38*b* in the second head unit 21*b* at a lower rate than through the supply passage 35. FIG. 10 is a graph showing the relationship between the total length L of nozzle arrays and a pressure applied to the meniscus in each nozzle 10 of the nozzle array. As can be seen from FIG. 10, the line obtained by plotting the pressures has a negative gradient. In this configuration, a property of the ink to be discharged through the nozzles 10 in both the first head unit 21*a* and the second head unit 21*b* varies less widely than that in a comparative configuration as indicated by the broken line in FIG. 10; the comparative configuration has nozzle arrays having the same total length as in this configuration but does not have a supply passage 35. A reason for the difference in property between these configurations is as follows: in this configuration, the difference between the pressures generated in the nozzles 10 which is attributed to the difference in height between the first supply opening 40*a* and the second supply opening 40*b* via which the ink is to be supplied to the common liquid chambers 38*a* and 38*b* is successfully canceled by the pressure loss of the ink in the supply passage 35; and in the comparative configuration, the difference in height between the ink surfaces in the nozzles 10 is not sufficiently canceled by the pressure loss of the supply passage 35. For example, in the comparative configuration, the difference between the pressures generated in the nozzles 10 at both ends of the nozzle array is approximately 600 Pa. In contrast, in this configuration, the difference in pressure is approximately 300 Pa, which is equal to half of 600 Pa. Other configurations are identical to those in the foregoing second embodiment.

Fourth Embodiment

Figure 11:
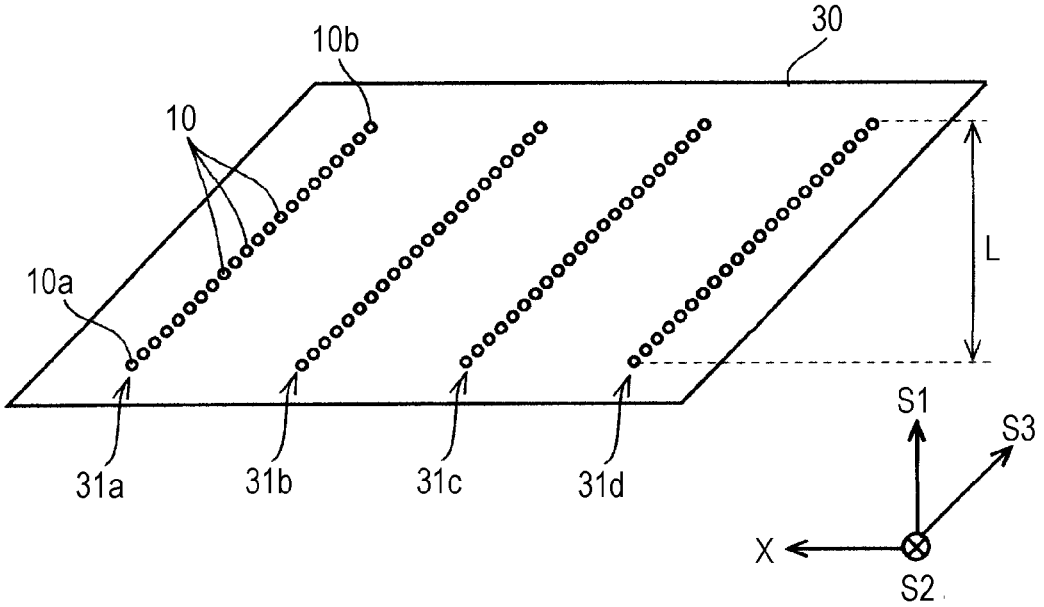
FIG. 11 illustrates a configuration of a nozzle forming surface according to a fourth embodiment of the present disclosure.
Figure 12:
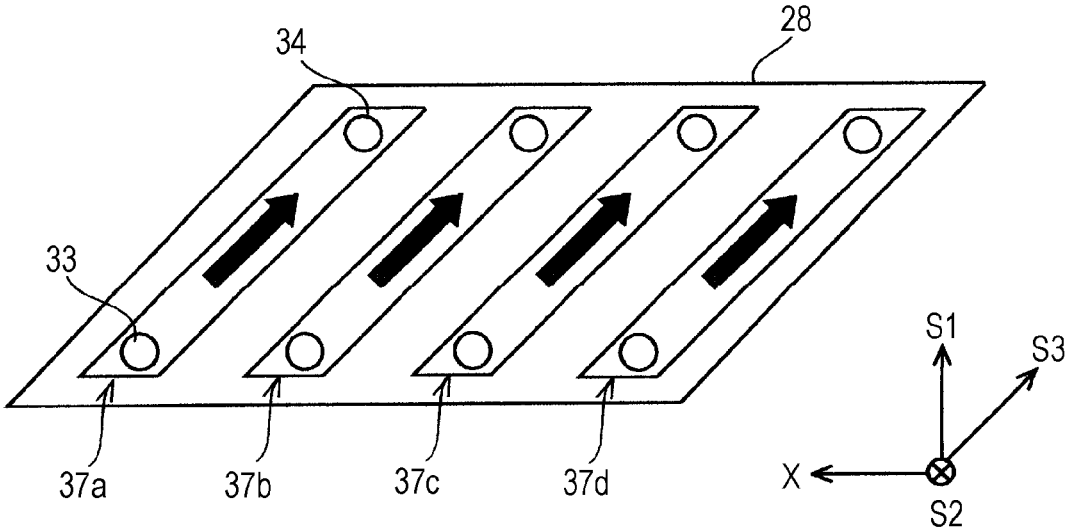
FIG. 12 illustrates a configuration of supply passages according to the fourth embodiment.

FIG. 11 illustrates a configuration of a nozzle forming surface, or a nozzle substrate 30, of a recording head according to a fourth embodiment of the present disclosure. FIG. 12 illustrates a configuration of supply passages 37*a* to 37*d* in a case 28 of the recording head. FIGS. 11 and 12 are related to each other. In FIGS. 11 and 12, components identical to those in the foregoing first, second, or third embodiment are given the same reference characters and will not be described below. In this embodiment, as illustrated in FIG. 11, nozzle arrays 31*a* to 31*d* are formed on the nozzle forming surface in the transport direction of a print medium M, or along an axis S3, which forms a predetermined angle with the axis S1. As an example, the angle between the axes S1 and S3 may be 45 deg. In relation to the nozzle arrays 31*a* to 31*d*, supply passages 37*a* to 37*d* are formed in the case 28 so as to extend along the axis S3, as illustrated in FIG. 12. When ink flows into the supply passage 37*a* through an inflow opening 33, the ink flows through the supply passage 37*a* in the direction indicated by the arrow and along the axis S3 and then reaches an outflow opening 34. Other configurations are identical to those in the foregoing first embodiment. In this embodiment, a control unit adjusts the rates at which the ink flows through the supply passages 37*a* to 37*d* in accordance with a length L of the nozzle arrays 31*a* to 31*d* along the axis S1 and the angle θ at which the nozzle forming surface is inclined. In this case, the difference between the pressures generated in nozzles 10 of the nozzle arrays 31*a* to 31*d* which is attributed to the difference in height between the liquid surfaces in the nozzles 10 is successfully canceled by pressure losses in the supply passages 37*a* to 37*d*. In this way, properties of the ink to be discharged through the nozzles 10 can be set uniformly.

A liquid ejecting head according to an embodiment of the present disclosure and a liquid ejecting apparatus according to an embodiment of the present disclosure with this liquid ejecting head may have any given configuration in which a plurality of nozzles are formed on a nozzle forming surface inclined with respect to a vertical axis. Examples of a liquid ejecting head according to an embodiment of the present disclosure include: a color material ejecting head for use in fabricating color filters for liquid crystal displays; an electrode material ejecting head for use in fabricating electrodes for organic electro luminescence (EL) displays and field emission displays (FEDs) such as surface emitting displays; and a bioorganic substance ejecting head for use in fabricating biochemical elements such as biochips. Examples of a liquid ejecting apparatus according to an embodiment of the present disclosure include liquid ejecting apparatuses having liquid ejecting heads as described above.

What is claimed is:

1. A liquid ejecting apparatus comprising:

a liquid ejecting head including a plurality of nozzles for discharging liquid and a supply passage through which the liquid to be supplied to the plurality of nozzles flows, the nozzles being arranged in a line, one of the nozzles at a first end of the line being a first end nozzle, one of the nozzles at a second end of the line being a second end nozzle, a height of the first end nozzle being set to be greater than a height of the second end nozzle, the liquid flowing through the supply passage in a direction from the first end nozzle to the second end nozzle, wherein the liquid ejecting apparatus adjusts a rate at which the liquid flows through the supply passage in accordance with a difference in height between the first end nozzle and the second end nozzle.

2. The liquid ejecting apparatus according to claim 1, the liquid ejecting head including a nozzle forming surface on which the plurality of nozzles are formed, and the nozzle forming surface being inclined to differently set the heights of the first end nozzle and the second end nozzle.

3. The liquid ejecting apparatus according to claim 2, wherein the nozzle forming surface is inclined to uniformly set a distance between the plurality of nozzles and a print material on which the liquid discharged from the nozzles.

4. The liquid ejecting apparatus according to claim 1, wherein the supply passage includes an inflow portion into which the liquid to be supplied to the plurality of nozzles flows and an outflow portion from which the liquid flows out, the inflow portion being disposed closer to the first end nozzle than to the second end nozzle, the outflow portion being disposed closer to the second end nozzle than to the first end nozzle, and the liquid circulates between the inflow portion and the outflow portion.

5. The liquid ejecting apparatus according to claim 1, wherein $$-5000 < Ph - Pf \leq 0 \quad (1),$$

Ph [Pa] is a difference between pressures generated in the first end nozzle and the second end nozzle which is attributed to a difference in height between surfaces of the liquid in the first end nozzle and the second end nozzle, and Pf [Pa] is a pressure loss in the supply passage between a point at which the liquid is supplied to the first end nozzle and a point at which the liquid is supplied to the second end nozzle.

6. The liquid ejecting apparatus according to claim 1, wherein $$-700 < Ph - Pf \leq 0 \quad (2),$$

Ph [Pa] is a difference between pressures generated in the first end nozzle and the second end nozzle which is attributed to a difference in height between surfaces of the liquid in the first end nozzle and the second end nozzle, and Pf [Pa] is a pressure loss in the supply passage between a point at which the liquid is supplied to the first end nozzle and a point at which the liquid is supplied to the second end nozzle.

7. The liquid ejecting apparatus according to claim 1, wherein $$\frac{\rho g}{8\mu} \cdot \sin\theta = \frac{v}{r^2}, \quad (3)$$

ρ [kg/m$^3$] is a density of the liquid,

μ [mPa·s] is a viscosity of the liquid,

L [m] is a distance between the first end nozzle and the second end nozzle, v [m/s] is a rate at which the liquid flows through the supply passage, r [m] is a radius of a cross section of the supply passage when the cross section is regarded as a perfect circle, and g [m/s$^2$] is a gravitational acceleration.

8. A liquid ejecting apparatus comprising:

a liquid ejecting head including a plurality of nozzles for discharging liquid and a supply passage through which the liquid to be supplied to the plurality of nozzles flows, the nozzles being arranged in a line, one of the nozzles at a first end of the line being a first end nozzle, one of the nozzles at a second end of the line being a second end nozzle, a height of the first end nozzle being set to be greater than a height of the second end nozzle, the liquid flowing through the supply passage in a direction from the first end nozzle to the second end nozzle, wherein the liquid ejecting head includes a plurality of head units equipped with the plurality of nozzles respectively, and wherein the plurality of head units are arranged side by side along the line in which the nozzles are arranged.

9. A liquid ejecting apparatus according to claim 1, further comprising:

a liquid storage portion that stores liquid to be supplied to the liquid ejecting head; and a liquid feeding mechanism configured to feed the liquid stored in the liquid storage portion to the supply passage in the liquid ejecting head.

10. A method of controlling a liquid ejecting apparatus that comprises a liquid ejecting head including a plurality of nozzles for discharging liquid and a supply passage through which the liquid to be supplied to the plurality of nozzles flows, the nozzles being arranged in a line, one of the nozzles at a first end of the line being a first end nozzle, one of the nozzles at a second end of the line being a second end nozzle, a height of the first end nozzle being set to be greater than a height of the second end nozzle, the liquid flowing through the supply passage in a direction from the first end nozzle to the second end nozzle, the method comprising:

adjusting a rate at which the liquid flows through the supply passage in accordance with a difference in height between the first end nozzle and the second end nozzle.

11. The method of controlling the liquid ejecting head according to claim 10, wherein the liquid flows through the supply passage at a higher rate as a density of the liquid becomes greater.

12. The method of controlling the liquid ejecting head according to claim 10, further comprising:

performing a flow rate adjusting operation to vary the rate at which the liquid flows through the supply passage when the liquid is not discharged through the nozzles.

* * * * *